US010362801B2

(12) United States Patent
Zitturi et al.

(10) Patent No.: US 10,362,801 B2
(45) Date of Patent: Jul. 30, 2019

(54) WRAPPING PAPER HAVING TRANSPARENT REGIONS

(71) Applicant: delfortgroup AG, Traun (AT)

(72) Inventors: Roland Zitturi, Innsbruck (AT); Dietmar Volgger, Gnadenwald (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 15/574,878

(22) PCT Filed: May 6, 2016

(86) PCT No.: PCT/EP2016/060215

§ 371 (c)(1),
(2) Date: Nov. 17, 2017

(87) PCT Pub. No.: WO2016/184698

PCT Pub. Date: Nov. 24, 2016

(65) Prior Publication Data

US 2018/0125114 A1 May 10, 2018

(30) Foreign Application Priority Data

May 19, 2015 (DE) ..... 10 2015 107 829

(51) Int. Cl.

| | |
|---|---|
| ***D21H 27/00*** | (2006.01) |
| ***A24D 1/02*** | (2006.01) |
| ***D21H 27/10*** | (2006.01) |
| ***D21H 15/02*** | (2006.01) |
| ***D21H 17/14*** | (2006.01) |
| ***D21H 17/67*** | (2006.01) |
| ***D21H 21/40*** | (2006.01) |
| ***D21H 23/22*** | (2006.01) |

(52) U.S. Cl.

CPC ..... *A24D 1/02* (2013.01); *D21H 15/02* (2013.01); *D21H 17/14* (2013.01); *D21H 17/675* (2013.01); *D21H 21/40* (2013.01); *D21H 23/22* (2013.01); *D21H 27/00* (2013.01); *D21H 27/10* (2013.01)

(58) Field of Classification Search

USPC ..... 162/139

See application file for complete search history.

(56) References Cited

U.S. PATENT DOCUMENTS

| | | | | |
|---|---|---|---|---|
| 4,020,850 | A * | 5/1977 | Cogbill, II | A24D 1/02 131/334 |
| 5,269,818 | A | 12/1993 | Kunesh et al. | |
| 6,138,684 | A | 10/2000 | Yamazaki et al. | |
| 6,799,578 | B2 * | 10/2004 | Snaidr | A24D 1/02 131/334 |
| 2004/0231685 | A1 * | 11/2004 | Patel | A24C 5/005 131/365 |
| 2015/0173416 | A1 | 6/2015 | Zitturi et al. | |

FOREIGN PATENT DOCUMENTS

| | | | | |
|---|---|---|---|---|
| EP | 0870871 | * | 10/1998 | D21H 17/67 |

OTHER PUBLICATIONS

International Searching Authority—EPO, International Search Report and Written Opinion, PCT/EP2016/060215; dated Aug. 22 2016. 11 pages.

* cited by examiner

*Primary Examiner* — Mark Halpern

(74) *Attorney, Agent, or Firm* — Sunstein Kann Murphy & Timbers LLP

(57) ABSTRACT

The invention relates to a wrapping paper for smoking articles that contains pulp fibers and at least one acid-soluble filler, the content of acid-soluble filler being at least 10 wt % relative to the entire mass of the wrapping paper, and the wrapping paper having portions with a lower transparency and portions with a higher transparency.

25 Claims, No Drawings

WRAPPING PAPER HAVING TRANSPARENT REGIONS

CROSS-REFERENCE TO RELATED APPLICATIONS

This Application is a U.S. national stage entry under 35 USC § 371 of Patent Cooperation Treaty Application PCT/EP2016/060215, filed May 6, 2016, which claims priority from German Patent Application 10 2015 107 829.5, filed May 19, 2015, both of which are incorporated herein by reference in their entireties.

FIELD OF THE INVENTION

The invention relates to a wrapping paper for smoking articles. In particular it relates to a wrapping paper for smoking articles, which has regions of higher transparency and regions of lower transparency, and a process for the production of such a wrapping paper. Furthermore, it relates to a smoking article comprising such a wrapping paper.

BACKGROUND AND PRIOR ART

A typical cigarette consists of a tobacco rod wrapped with a cigarette paper. In many cases, cigarettes are also equipped with a filter, typically made from cellulose acetate, which is wrapped by a filter wrapping paper and is additionally wrapped on the outside by a tipping paper, which is slightly longer than the filter and thus connects the filter to the tobacco rod wrapped with the cigarette paper. Such cigarettes are usually consumed by burning the tobacco and the smoke created thereby is inhaled by the smoker through the filter.

Alternative smoking articles do not burn the tobacco but just heat it, whereupon an aerosol is released which is inhaled by the smoker. It is assumed that the aerosol of such smoking articles contains fewer harmful substances than the smoke of conventional cigarettes. Instead of tobacco, other aerosol-generating substances can also be used. Depending on the construction of these smoking articles, a wrapping paper can also be required for such smoking articles which wraps the tobacco or the aerosol-generating substance or other parts of the smoking article.

When designing wrapping paper for smoking articles, the optical properties of the wrapping paper play an important role in addition to the technical requirements. Because advertising for smoking articles, in particular for cigarettes, is restricted or widely prohibited in many countries, one way round this consists in distinguishing the smoking article in the perception of the consumer by the design of the smoking article itself. Thus, the wrapping paper of the smoking article is an important tool, because in conventional smoking articles, it forms most of the outer surface of the smoking article. Typical properties of the wrapping paper which are relevant to distinguishing the smoking article are whiteness, transparency or opacity, gloss, water marks, vergé lines or patterns such as logos or text applied to the wrapping paper, for example by printing. The appearance of the ash after consumption of the smoking article can also play a role.

An essential feature of the wrapping paper for the differentiation of the smoking article is its transparency, i.e. the ability to let light shine through it. An increased transparency means that more light passes through the wrapping paper. On smoking articles, the regions of higher transparency on the wrapping paper usually appear darker, as the tobacco or the aerosol-generating material located under the wrapping paper shines through.

A typical wrapping paper for smoking articles comprises pulp fibers, for example wood pulp or flax pulp, and one or more filler materials, for example calcium carbonate. Wrapping papers without filler materials are comparatively transparent, while the transparency decreases with increasing filler content. The selection of the filler can also influence the transparency. In particular, titanium dioxide as a filler can significantly decrease the transparency. In conventional production processes for wrapping papers for smoking articles, the transparency of the wrapping paper can be influenced by the composition of the wrapping paper as a whole, but not in regions.

To distinguish a smoking article, it may be desirable for the wrapping paper to contain regions of higher and lower transparency. For that purpose, various methods are available in the prior art which, however, are not without disadvantages.

A method known in the prior art is to compress the wrapping paper in certain regions. Because of the lower thickness and the denser paper structure, the wrapping paper becomes more transparent in the compressed regions. In this manner, for example, water marks or so called vergé lines can be produced. Vergé lines are narrow lines along which the wrapping paper is compressed, so that they can form darker lines on the smoking article in the circumferential or the longitudinal direction. Any pattern can be produced in the wrapping paper using this same conventional method for the production of vergé lines.

While the production of water marks or vergé lines is usually carried out during the production of the wrapping paper on the paper machine, as an alternative method, the wrapping paper can also be embossed after production on the paper machine. Here again, the wrapping paper is compressed and as regards the optical appearance and the influence on other properties of the wrapping paper, the method is similar to the production of water marks or vergé lines.

A technical disadvantage of both methods is that the compression substantially reduces the air permeability of the wrapping paper. The air permeability of the wrapping paper allows the access of air from the outside through the wrapping paper into the smoking article. In this manner, the smoke or the aerosol is diluted and the amount of potentially harmful substances in the smoke or the aerosol is reduced. A reduction in the air permeability of the wrapping paper in the compressed regions is thus generally a disadvantage.

A further disadvantage of the known methods is that the compression reduces the thickness of the wrapping paper in some regions. The surface of the wrapping paper thus becomes rougher and compromises the haptic qualities of the wrapping paper.

Finally, the known methods have the further disadvantage that in the tensile strength of the wrapping paper is reduced the compressed regions. In particular, if the compressed regions extend transversely across the wrapping paper, they create weak points in machine direction, which may cause tearing of the wrapping paper during further processing.

A further method may be to use a wrapping paper which is translucent over its entire surface as a starting point and to print it in regions so that it becomes less transparent in these regions. However, to accomplish this, compositions which contain at least one pigment or a colorant and at least one binder have to be applied to these regions.

In many cases, colorants are prohibited by law for use in wrapping papers for smoking articles, so that generally, only pigments can be used. In both cases, however, a binder is required, which needs to be applied to the wrapping paper in a comparatively large amount in order to fix the pigments or colorants to the wrapping paper. However, this binder closes the pore structure of the wrapping paper and reduces the air permeability even more than is the case for embossing. Thus, the amount of carbon monoxide and other harmful substances in the smoke is increased, which is not desirable.

Thus, there is a need to have a wrapping paper available which has an increased transparency in certain regions, but which does not change substantially in other properties such as air permeability, thickness and tensile strength.

SUMMARY OF THE INVENTION

The objective of the present invention is to provide a wrapping paper for smoking articles, which has regions of higher and lower transparency and the air permeability, thickness and tensile strength in the regions of higher and lower transparency do not substantially differ from each other or at least do not deteriorate substantially in relation to the use on a smoking article. Although the regions of higher transparency serve to achieve a particular optical appearance, their production presents a technical problem which is to be solved by technical means and further has the purpose—in contrast to the prior art—to not or not substantially negatively affect further technical properties of the wrapping paper.

This objective is achieved by a wrapping paper according to claim 1, as well as by a process for the production of such a wrapping paper according to claim 24 and a smoking article comprising such a wrapping paper according to claim 35. Advantageous further embodiments are disclosed in the dependent claims.

The inventors have found that the objective can be achieved by a wrapping paper for smoking articles which contains pulp fibers and at least one acid-soluble filler material, wherein the content of the acid-soluble filler material is at least 10% by weight with respect to the mass of the wrapping paper as a whole, and wherein the content as the mass per unit area of this acid-soluble filler within regions of the wrapping paper is at least 10% less than in other regions of the wrapping paper. This means, for example, that if the acid-soluble filler content in some regions is 5 g/m$^2$, it is at most 4.5 g/m$^2$ in other regions.

For the wrapping paper according to the invention, the regions with the filler content reduced by at least 10% form regions of higher transparency, and the other regions form regions of lower transparency. If the regions are sufficiently large so that the transparency can be reliably measured in accordance with DIN 53147:1993-01, the transparency in the regions of higher transparency should be at least 20% higher than the transparency measured in accordance with DIN 53147:1993-01 in the regions of lower transparency. However, depending on the desired transparency pattern, it is possible for the regions of higher transparency and/or the regions of lower transparency to be so small or of such a shape that they cannot be measured with sufficient accuracy in accordance with DIN 53147:1993-01. In this case, the transparency in the regions of higher transparency should be so much higher than in the regions of lower transparency that, in the case where the wrapping paper is wrapped around a typical tobacco rod, a pattern of lighter and darker sections is obtained, which is perceivable by the naked eye, wherein the darker sections correspond to the regions of higher transparency and the lighter sections correspond to the regions of lower transparency. For judging the difference in transparency, a tobacco rod will be considered typical if it is filled with an American Blend tobacco blend, has a diameter between 7 mm and 8 mm and an average filling density of between 0.1 g/cm$^3$ and 0.3 g/cm$^3$. Since the purpose of the invention is the production of a transparency pattern which is visible to the naked eye similar to those obtained in the prior art by embossing, this second criterion is a suitable criterion on which to characterize the wrapping paper according to the invention with respect to the transparency.

The inventors have found that by treating a wrapping paper which has an initially homogeneous composition, the content of acid-soluble filler material can be reduced in regions of the wrapping paper by applying an acid-containing composition. This composition dissolves the filler material in certain regions and thereby reduces the filler content in these regions and can lead to an increase in transparency. In preferred embodiments, further generally positive effects on the wrapping paper are obtained, in particular with respect to the tensile strength; the reason for this cannot yet be explained by the inventors.

It is clear to the skilled person that a reduced filler content can lead to a higher transparency, but only in relation to the wrapping paper as a whole, i.e. over its entire surface. There are no experiments known to the inventors, wherein the transparency can be varied locally by the filler content in order to produce visible transparency patterns, let alone suitable methods with which this can be achieved efficiently. The inventors have also found that the filler content can be reduced in certain regions by the treatment with an acid, but that this does not always go hand in hand with an increase in the transparency. As will be further explained below, they have surprisingly found that only with specifically selected acids and appropriately selected pH can the reduced filler content in fact lead to a considerable increase of the transparency. In particular, the effect could not be achieved with acids immediately obvious to the skilled person.

In this regard, specific embodiments are disclosed below, in which the desired effect can be effectively achieved. Starting from this teaching and the proof provided hereby that the effect according to the invention can be achieved by properly selected acids and properly selected pHs, the skilled person is put in a position to identify, by systematic experiments, further embodiments and in particular further acids and pHs which are not provided in the present disclosure.

Preferably, the regions of higher transparency form a regular, i.e. not random, pattern. This pattern can be regularly arranged geometrical shapes, in particular lines or stripes, text, watermarks or logos.

Although the starting point of the present invention consists in effectively producing transparency patterns of regions of higher and lower transparency on the wrapping paper, it was found that the treatment disclosed for that purpose in some cases does not only not deteriorate the properties of the wrapping paper, but instead improves them, in particular in relation to the tensile strength. In this regard, the invention also provides for some embodiments to treat the wrapping paper over its full surface in order to increase its transparency overall and/or to increase the tensile strength.

The said pulp fibers are preferably wood pulp fibers, particularly preferably pulp fibers from long-fiber pulp or short-fiber pulp and mixtures thereof. Preferably, the pulp fibers are partially or completely formed by pulp fibers of other plants, such as flax, hemp, sisal, jute, abacá, cotton, esparto grass or mixtures thereof. In general, there are no restrictions in the selection of the pulp fibers for the wrapping paper according to the invention, so that the wrapping paper can, for example, also contain pulp fibers of regenerated cellulose such as lyocell fibers, viscose fibers or modal fibers. Legal requirements regarding the constituents of a wrapping paper for smoking articles are, of course, to be observed.

The wrapping paper preferably contains at least 50% by weight, particularly preferably at least 60% by weight, and most particularly preferably at least 70% by weight of pulp fibers and preferably at most 90% by weight, particularly preferably at most 80% by weight of pulp fibers. The percentages refer to the total mass of the wrapping paper.

The said acid-soluble filler material is preferably an acid-soluble carbonate or hydrogen carbonate, in particular a calcium carbonate, a calcium hydrogen carbonate, a magnesium carbonate, or a mixture thereof. Less preferred, but usable are filler materials with lower solubility in acids, such as magnesium oxide, magnesium hydroxide or aluminum hydroxide. Although titanium dioxide leads to a high opacity and whiteness of the wrapping paper, it is not suitable as an acid-soluble filler material for the present invention; talc and kaolin are also suitable. Other filler materials, for example titanium dioxide, can provide a particular color to the ash of the wrapping paper and for this reason are not desirable.

The effect of the acid on the acid-soluble filler material is primarily of a chemical nature, so that there are no particular limitations for the particle size, particle shape and crystal structure of the acid-soluble filler material. The mean particle size of the acid-soluble filler material can be preferably at least 0.01 μm, particularly preferably at least 0.1 μm and most particularly preferably at least 0.5 μm and/or at most 10 μm, particularly preferably at most 5 μm and most particularly preferably at most 3 μm.

As described above, the wrapping paper contains at least 10% by weight, preferably at least 15% by weight, particularly preferably at least 20% by weight and most particularly preferably at least 25% by weight of the acid-soluble filler material, and preferably at most 50% by weight, particularly preferably at most 40% by weight and most particularly preferably at most 35% by weight of the acid-soluble filler material. The percentages refer to the total mass of the wrapping paper, wherein to determine the filler content, no differentiation is made between the region with reduced and non-reduced content of acid-soluble filler material.

The difference in transparency increases if the difference in the content of acid-soluble filler material in the corresponding regions increases. In the regions of higher transparency of the wrapping paper the content of acid-soluble filler material is thus, as described above, reduced by at least 10% compared to the content in regions of lower transparency. Preferably, however, it is reduced by at least 15%, particularly preferably by at least 20% and most particularly preferably by at least 25%. The percentages refer to the filler content as the mass per unit area within the respective regions. Thus, if the filler content is 8 $g/m^2$ in one region of lower transparency and is 6 $g/m^2$ within a region of higher transparency, the reduction is 25%.

It is possible for no more acid-soluble filler material to be contained in the regions of higher transparency, but by the process proposed further below, this can only be achieved with difficulty. The content of acid-soluble filler material in the regions of higher transparency is thus reduced compared with the content in the regions of lower transparency by at most 100%, preferably at most 80%, particularly preferably by at most 60% and most particularly preferably by at most 50%. These percentages also refer to the filler content as the mass per unit area within the respective regions.

The fraction of the area of the regions of higher transparency, i.e. with reduced content of acid-soluble filler material, with respect to the total area of the wrapping paper can vary. To achieve a particularly well perceptible optical effect, the fraction should preferably be at least 1%, particularly preferably at least 3% and most particularly preferably at most 5%. In addition, the fraction should be at most 99%, particularly preferably at most 97% and most particularly preferably at most 95%.

In a most particularly preferably embodiment, that fraction of the area of the regions with a reduced content of acid-soluble filler material with respect to the total area of the wrapping paper is at least 10% and at most 70%.

In addition to the at least one acid-soluble filler material, the wrapping paper can contain further not acid-soluble filler materials. These filler materials are preferably oxides, hydroxides or silicates, particularly preferably titanium dioxide, talcum, kaolin or mixtures thereof.

The total content of the filler materials, i.e. of acid-soluble and not acid-soluble filler materials, is at least 10% by weight and preferably at least 15% by weight and particularly preferably at least 20% by weight and most particularly preferably at least 25% by weight of the mass of the wrapping paper, and preferably at most 50% by weight, particularly preferably at most 40% by weight and most particularly preferably at most 35% by weight of the mass of the wrapping paper. It is always presupposed that the acid-soluble filler material content is at least 10% by weight of the mass of the wrapping paper.

The transparency of the wrapping paper, measured in accordance with DIN 53147:1993-01, is increased in the regions with reduced content of acid-soluble filler material. As described above, it is increased in certain regions, namely the "regions of higher transparency", by at least 20% compared to the transparency in other regions ("regions of lower transparency"). Preferably, the increase in transparency is at least 25%, particularly preferably at least 30% and most particularly preferably at least 50%, and preferably at most 300%, particularly preferably at most 200% and most particularly preferably at most 100%. The percentages are to be understood relative to the value of the transparency in the regions of lower transparency. Thus, for example, if the transparency in a region of lower transparency is 30%, then a transparency of 45% in a region of higher transparency is an increase of 50%.

The transparency of the regions can be increased by partial or complete removal of the acid-soluble filler material, but in these regions at least the pulp fibers still remain so that in addition, the transparency cannot be increased indefinitely in absolute values.

The transparency of the wrapping paper in the regions of reduced content of acid-soluble filler material, i.e. in "regions of higher transparency", measured in accordance with DIN 53147:1993-01, is thus preferably at least 20%, particularly preferably at least 40% and most particularly preferably at least 50%, and preferably at most 90%, particularly preferably at most 70% and most particularly preferably at most 60%.

The transparency of the wrapping paper outside of these regions should be rather low. Thus, in the regions of lower transparency it is preferably at most 70%, particularly preferably at most 60% and most particularly preferably at most 50% and preferably at least 0%, particularly preferably at least 10%, measured in accordance with DIN 53147:1993-01.

With regards to the transparency in the corresponding regions, of course, the aforementioned relative ratios to each other need to be observed, in particular that the transparency in the regions of higher transparency is in fact higher than in the regions of lower transparency.

For use on smoking articles, the basis weight of the wrapping paper is preferably at least 10 $g/m^2$, particularly preferably at least 20 $g/m^2$, and preferably at most 100 $g/m^2$, particularly preferably at most 60 $g/m^2$ and most particularly preferably at most 45 $g/m^2$.

An important property of the wrapping paper for further processing into a smoking article is its tensile strength, which can be measured in accordance with ISO 1924-2: 2008. A particular advantage of the invention is that the tensile strength of the wrapping paper is higher than for wrapping papers known in the prior art, for which, for example, the transparency has been modified by compression of certain regions. In particular, it was found that the tensile strength can even be increased by the process described below compared to a wrapping paper with homogeneous filler material distribution. The tensile strength of a wrapping paper is strongly influenced by its basis weight. In particular, it is approximately proportional to the basis weight, so that the tensile strength in accordance with ISO 1924-2:2008, in N/15 mm, can be expressed relative to the basis weight in $g/m^2$, measured in accordance with ISO 536:2012, and thus a tensile strength relative to the mass is obtained in $N \cdot m^2/(15\ mm \cdot g)$.

The tensile strength relative to the mass, calculated as the quotient of the tensile strength in accordance with ISO 1924-2:2008 and the basis weight in accordance with ISO 536:2012, is preferably at least 0.3 $N \cdot m^2/(15\ mm \cdot g)$ and particularly preferably at least 0.4 $N \cdot m^2/(15\ mm \cdot g)$, most particularly preferably at least 0.5 $N \cdot m^2/(15\ mm \cdot g)$ and preferably at most 1.6 $N \cdot m^2/(15\ mm \cdot g)$, particularly preferably at most 1.4 $N \cdot m^2/(15\ mm \cdot g)$ and most particularly preferably at most 1.2 $N \cdot m^2/(15\ mm \cdot g)$.

The thickness of the wrapping paper is of importance for use on smoking articles. On the one hand it plays a role for processing, for example, with respect to the ability to absorb adhesives, but on the other hand the thickness of the wrapping paper on the smoking article should be uniform, to provide a homogeneous optical and haptic impression.

The thickness of the wrapping paper, measured in accordance with ISO 534:2012 on a single layer, is thus preferably at least 15 μm, particularly preferably at least 20 μm and preferably at most 100 μm and particularly preferably at most 80 μm.

More important than the absolute thickness is that the thickness in regions of higher transparency is not substantially different from the thickness in regions of lower transparency. This is an essential advantage of the wrapping paper according to the invention compared with wrapping papers which are compressed in certain regions to increase the transparency or which are printed in certain regions to reduce the transparency.

The quotient of the thickness in the regions of higher transparency and the thickness in the regions of lower transparency is preferably at least 0.5, particularly preferably at least 0.7, most particularly preferably at least 0.8 and preferably at most 1.8, particularly preferably at most 1.6, most particularly preferably at most 1.5.

Both thicknesses can be measured in accordance with ISO 534:2011 on a single layer. As the measurement area for the thickness measurement in accordance with ISO 534:2011 can be larger than the regions of higher or lower transparency, the measurement can alternatively be carried out on an otherwise identical wrapping paper, which has sufficiently large regions. Alternatively a microscopic analysis of the cross-section of the wrapping paper can be used to determine the thickness and in particular the quotient of both thicknesses, for example, by using a scanning electron microscope.

A further important property of the wrapping paper is its air permeability. The air permeability allows air to flow through the wrapping paper as a function of the pressure difference between the sides of the wrapping paper. On smoking articles, in particular cigarettes, the smoker creates a pressure difference between the inside of the smoking article and the surroundings so that air flows through the wrapping paper into the smoking article and can thus dilute the smoke or the aerosol in the smoking article. In this manner, the amount of harmful substances in the smoke or the aerosol can be reduced.

The air permeability of the wrapping paper, measured in accordance with ISO 2965:2009, is preferably at least 5 $cm^3/(cm^2 \cdot min \cdot kPa)$, particularly preferably at least 20 $cm^3/(cm^2 \cdot min \cdot kPa)$ and preferably at most 300 $cm^3/(cm^2 \cdot min \cdot kPa)$, particularly preferably at most 200 $cm^3/(cm^2 \cdot min \cdot kPa)$, most particularly preferably at most 150 $cm^3/(cm^2 \cdot min \cdot kPa)$.

A particular advantage of the invention compared to wrapping papers for which the transparency has been increased in regions by compression is that the difference in the air permeability between regions in which the content of acid-soluble filler material is reduced and the remaining regions of the wrapping paper is small.

The quotient of the air permeability in regions of higher transparency and the air permeability in regions of lower transparency is preferably at least 0.4, particularly preferably at least 0.5, most particularly preferably at least 0.6 and preferably at most 1.6, particularly preferably at most 1.4, most particularly preferably at most 1.2.

For comparison, for a paper for which the transparency has been in increased in regions by compression or reduced in regions by printing, the quotient is typically less than 0.1 or greater than 10.

The air permeability of the regions and of the wrapping paper can be measured in accordance with ISO 2965:2009. This standard only allows a minimal measurement area of 2×15 mm, so that in many practical cases, the measurement area will cover regions of higher as well as of lower transparency. To measure the overall air permeability, this fact can be ignored. To measure the air permeability in the respective regions, the measurement can be carried out in the regions of an otherwise identical wrapping paper, on which sufficiently large regions are provided. Alternatively, the air permeability of the regions can be calculated from at least two measurements of the air permeability for which the fraction of regions of higher transparency in the measurement area is known and differs substantially from measurement to measurement. The basic assumption here is that the total air flow flowing through the measurement area during measurement is the sum of the air flow through the regions of higher transparency and through the regions of lower transparency.

In addition to the air permeability, the diffusion capacity of the wrapping paper is also of importance. The diffusion capacity can be measured in accordance with CORESTA Recommended Method No. 77 (April 2014) and describes the gas transport through the wrapping paper due to a concentration difference between the two sides of the wrapping paper. The diffusion capacity of the wrapping paper is of importance for smoking articles, because during phases during which the smoker does not puff the smoking article, i.e. during which no pressure difference exists between the inside of the smoking article and the surroundings, gases, in particular carbon monoxide and carbon dioxide, can diffuse through the wrapping paper and can thereby decrease the content of these gases in the smoke or the aerosol.

The diffusion capacity of the wrapping paper measured in accordance with CORESTA Recommended Method No. 77 (April 2014) is preferably at least 0.05 cm/s, particularly preferably at least 0.1 cm/s and preferably at most 5 cm/s, particularly preferably at most 3.5 cm/s.

Here again, the fact that the measurement area typically simultaneously covers regions of higher and lower transparency can be ignored for the measurement of diffusion capacity.

The diffusion capacity of the regions of higher transparency can also be measured in accordance with CORESTA Recommended Method No. 77 (April 2014), when the size of the regions is sufficient. Alternatively, an otherwise identical wrapping paper can be used for the measurement, for which these regions are designed to be sufficiently large. Also as a further alternative, as explained above for the measurement of air permeability, the diffusion capacity of the regions of higher and lower transparency can be calculated from at least two measurements if the fraction of the measurement area which can be attributed to the respective regions is known for each measurement.

The diffusion capacity of the regions with reduced content of acid-soluble filler material, i.e. of the regions of higher transparency, is preferably at least 0.01 cm/s, particularly preferably at least 0.02 cm/s, most particularly preferably at least 0.05 cm/s and preferably at most 3 cm/s, particularly preferably at most 2.5 cm/s, most particularly preferably at most 2 cm/s.

In a preferred embodiment of the wrapping paper according to the invention, the regions are designed with respect to their geometry and shape such that a smoking article, in particular a cigarette, has self-extinguishing properties. This can mean that, tested in accordance with ISO 12863:2010, preferably at least 30%, particularly preferably at least 50% and most particularly preferably at least 75% of the smoking articles from a sample of, for example, 40 smoking articles self-extinguish.

In this preferred embodiment, the regions can preferably be designed as bands passing across the wrapping paper, so that on a smoking article manufactured therefrom, there is at least one band, particularly preferably at least two bands in circumferential direction. The width of such a band in the longitudinal direction of the smoking article is preferably at least 4 mm, particularly preferably at least 5 mm, and preferably at most 10 mm, particularly preferably at most 8 mm.

In this preferred embodiment, the regions in which the content of acid-soluble filler material is reduced, i.e. the regions of higher transparency, preferably have a diffusion capacity measured in accordance with CORESTA Recommended Method No. 77 (April 2014) of at least 0.01 cm/s, particularly preferably of at least 0.02 cm/s, most particularly preferably of at least 0.05 cm/s, and preferably of at most 0.5 cm/s, particularly preferably of at most 0.3 cm/s, most particularly preferably of at most 0.2 cm/s.

The wrapping paper can, of course, be equipped with further functions and features that are known in the prior art, as long as they are compatible with the desired effect, namely regions of higher and lower transparency on the wrapping paper.

The wrapping paper according to the invention can be produced by the following process according to the invention.

In a first step, a preliminary wrapping paper is provided, which contains pulp fibers and at least one acid-soluble filler material, wherein the content of acid-soluble filler material is at least 10% by weight with respect to the mass of the preliminary wrapping paper.

Regarding the pulp fibers, the at least one acid-soluble filler material and other filler materials and additives which are contained in the preliminary wrapping paper, the same limits regarding type and amount apply as are disclosed above with respect to the finished wrapping paper.

Preferably, the content of the acid-soluble filler material and the transparency of this preliminary wrapping paper are homogeneous over its entire surface, as far as the usual production tolerances will allow. Such a preliminary wrapping paper can be produced according to the paper manufacturing processes in the prior art.

To this preliminary wrapping paper, a composition which contains at least one acid and water is applied in certain regions, wherein the acid is a trivalent acid, preferably a trivalent organic acid and most particularly preferably citric acid and the pH of the composition is at least 0 and at most 2, preferably about 1.

After application of the composition, the wrapping paper is dried.

The composition can contain further acids, but for the implementation of the invention, monovalent or divalent acids have been found to be less useful, so that the fraction of non-trivalent acids in the composition should be low. Preferably, the molar ratio between the total amount of trivalent acids and the total amount of acids should be greater than 0.7, particularly preferably greater than 0.8 and most particularly preferably greater than 0.9.

The composition can comprise further components which improve processing of the composition, i.e. which, for example, influence the viscosity or act as binders. Preferably, the composition thus contains at least one binder selected from the group consisting of starch, starch derivatives, modified starch, cellulose derivatives or a mixture thereof, particularly preferably modified starch and most particularly preferably maltodextrin.

The content of these further components in the composition is preferably at least 0.1% by weight, particularly preferably at least 0.5% by weight, most particularly preferably at least 2% by weight of the composition, and preferably at most 30% by weight, particularly preferably at most 20% by weight, most particularly preferably at most 10% by weight of the composition.

The composition can be applied to the entire area or in regions of the wrapping paper. If it is carried out only in regions, the fraction of the area of the regions to which the composition is applied, with respect to the total area of the wrapping paper is preferably at least 1%, particularly preferably at least 3% and most particularly preferably at least 5%. Similarly, the fraction can preferably be at most 99%, particularly preferably at most 97% and most particularly preferably at most 95%.

In a most particularly preferable embodiment, the fraction of the area to which the composition has been applied with respect to the total area of the wrapping paper is at least 10% and at most 70%.

The shape of the regions can, for example, represent lines, patterns, logos or text and is only restricted by the limitations of the application process.

The application of the composition can preferably be carried out by a printing process, particularly preferably by rotogravure printing, flexographic printing or offset printing or by spraying.

The amount of applied composition with respect to the area to which the composition is applied is preferably at least 0.5% by weight, particularly preferably at least 5.0% by weight of the basis weight of the finished wrapping paper, and preferably at most 50% by weight, particularly preferably at most 30% by weight of the basis weight of the finished wrapping paper.

After drying, the wrapping paper can be moistened, preferably by an application of water or water vapor to essentially the entire surface on one or two sides of the wrapping paper, to reduce or eliminate mechanical stress or folds caused by the application of the composition.

Further to this optional step, the wrapping paper can be dried to the equilibrium moisture content of about 3-7% by weight with respect to the mass of the finished wrapping paper. Then the wrapping paper can be wound up or further processing steps can be carried out. One possible such further processing step can be slitting into narrow reels, known as bobbins, the width of which is typically derived from the circumference or an integer multiple of the circumference of the smoking article to be manufactured therefrom.

Of course, further processing steps known in the prior art can be carried out with the wrapping paper, as long as they are compatible with the desired effect, namely to produce a change in transparency on the wrapping paper.

From the wrapping paper, a smoking article can be manufactured according to processes known in the prior art. Preferably, such a smoking article, which contains the wrapping paper according to the invention, will be a cigarette, most particularly preferably a filter cigarette.

DESCRIPTION OF THE PREFERRED EMBODIMENTS

The invention should be further explained by an example of a preferred embodiment.

Firstly, a preliminary wrapping paper for smoking articles with a basis weight of about 25 g/m$^2$ and a filler content of about 30% by weight, i.e. 7.5 g/m$^2$, was produced. Precipitated calcium carbonate was used as the only and at the same time acid-soluble filler material. The pulp fibers in the preliminary wrapper were a mixture of long fibers and short fibers. The nominal air permeability (Z), in accordance with ISO 2965:2009, of the preliminary wrapping paper was 60 cm$^3$/(cm$^2$·min·kPa), the diffusion capacity (D*) in accordance with CORESTA Recommended Method No. 77 (April 2014) was about 1.4 cm/s. The data regarding thickness and tensile strength, absolute as well as with respect to weight, can be found in Table 1, in which the data for the preliminary wrapping paper is provided as "paper 1".

Various compositions were applied to this preliminary wrapping paper using a laboratory printing device: "Printing Proofer 628" from the company RK Print-Coat Instruments Ltd.

The compositions are given in the rows for the papers 2-19 in Table 1. All compositions contained water. For the composition for paper 2, only 10% by weight of maltodextrin was added to the water, to be able to observe the effect of the maltodextrin in isolation. For papers 3-6, hydrochloric acid, i.e. a monovalent inorganic acid, was used in addition to maltodextrin, so that the composition had a pH from 4 (paper 3) to 1 (paper 6). For papers 7-10, maltodextrin (10% by weight) and acetic acid, i.e. a monovalent organic acid, were used in the composition, again with a range of the pH of the composition from 4 (paper 7) to about 1 (paper 10). For the papers 11-14 maltodextrin (10% by weight) and oxalic acid, a divalent organic acid, were used in the composition with a range of the pH of the composition from 4 (paper 11) to 1 (paper 14). Finally, for papers 15-19, citric acid, a trivalent organic acid, was used, with a pH for the composition from 4 (paper 15) to 1 (papers 18 and 19). In the composition for the papers 15-18, 10% by weight maltodextrin was again used, but for paper 19, the composition was produced without maltodextrin, to observe the effect of the acid alone.

As will be shown below, only the compositions for the papers 18 and 19 lead to the desired result and thus to wrapping paper according to the invention. The papers 3-17 which are not according to the invention show that, contrary to the expectations of the skilled person, the desired effect can only be achieved with a trivalent acid at a correspondingly low pH.

After the application of the composition to the preliminary wrapping paper, the wrapping paper was dried and after corresponding conditioning in accordance with ISO 187 at 23° C. and 50% relative humidity, the paper was tested with respect to various properties. The regions to which the composition was applied were sufficiently large, so that the measured values for the papers 2-19 regarding basis weight, thickness and tensile strength (absolute and relative to weight) in Table 1 refer to areas to which the composition has been applied over the entire area. For papers 2-19, the values for air permeability (Z), diffusion capacity (D*), filler content and transparency according to Table 2 were determined on samples of the wrapping paper to which the composition had been applied over the entire surface.

Of the applied composition, the major part of the maltodextrin and also a fraction of the reaction products of the acid with the acid-soluble filler material remained on the wrapping paper, so that it caused an increase in basis weight. This can be seen in Table 1, which shows for papers 2-19 an increase in basis weight from originally 25.54 g/m$^2$ for the preliminary wrapping paper 1 to at least 27.14 g/m$^2$ (paper 6) and up to 31.97 g/m$^2$ (paper 18).

The increase in the basis weight explains why the thickness of the papers 2-19 was slightly higher than the thickness of the preliminary wrapping paper 1. According to Table 1, the thickness of the preliminary wrapping paper was 41 μm, while that of the papers 2-19 varied between 42.80 μm (paper 16) and 48.11 μm (paper 7).

In comparison, the thickness of a paper which had been compressed in certain regions would be substantially lower in these regions.

In addition, the absolute value of the tensile strength, Table 1, was slightly higher for papers 2-17 compared with the preliminary wrapping paper 1. This slight increase of the tensile strength is to a large part caused by the application of the maltodextrin. For papers 18 and 19, for which a trivalent acid had been applied in a composition with a pH of below 2, on the other hand, a noticeable increase in the tensile strength from 15.71 N/15 mm for the preliminary wrapping paper 1 to 26.45 N/15 mm for paper 18 and 26.03 N/15 mm for paper 19 was observed. This increase in tensile strength is positive for processing the wrapping paper into a smoking article and is an advantage of the wrapping paper according to the invention.

In addition, for the tensile strength relative to weight, Table 1, only a small increase for the papers 2-17 was found compared with the preliminary wrapping paper 1, while for the papers 18 and 19 treated with a trivalent organic acid with a pH of 1 a noticeable increase in the tensile strength relative to weight from 0.615 $N \cdot m^2/(15\ mm \cdot g)$ for the preliminary wrapping paper 1 to 0.827 $N \cdot m^2/(15\ mm \cdot g)$ for paper 18 and 0.839 $N \cdot m^2/(15\ mm \cdot g)$ for paper 19 was found. This shows that there is an increase in tensile strength which, for the wrapping papers according to the invention 18 and 19, goes beyond the effect due to the increase of the basis weight.

TABLE 1

| | Applied Composition | | | Tensile Strength | | | |
|---|---|---|---|---|---|---|---|
| | | | | Basis | | Absolute | By Weight |
| Paper No. | Maltodextrin % by weight | Acid | pH | Weight $g/m^2$ | Thickness mm | N/15 mm | $N \cdot m^2/(15\ mm \cdot g)$ |
| 1 | | none | | 25.54 | 41.00 | 15.71 | 0.615 |
| 2 | 10 | none | 6.74 | 27.60 | 43.20 | 17.95 | 0.650 |
| 3 | 10 | hydrochloric acid | 4 | 27.92 | 44.11 | 18.33 | 0.656 |
| 4 | 10 | hydrochloric acid | 3 | 29.39 | 46.00 | 19.18 | 0.653 |
| 5 | 10 | hydrochloric acid | 2 | 28.26 | 45.17 | 18.32 | 0.648 |
| 6 | 10 | hydrochloric acid | 1 | 27.14 | 44.44 | 16.89 | 0.622 |
| 7 | 10 | acetic acid | 4 | 27.88 | 48.11 | 18.33 | 0.657 |
| 8 | 10 | acetic acid | 3 | 27.58 | 45.67 | 17.35 | 0.629 |
| 9 | 10 | acetic acid | 2 | 28.54 | 46.11 | 19.07 | 0.668 |
| 10 | 10 | acetic acid | 1.28 | 27.86 | 44.78 | 17.56 | 0.630 |
| 11 | 10 | oxalic acid | 4 | 27.74 | 44.78 | 17.63 | 0.636 |
| 12 | 10 | oxalic acid | 3 | 28.88 | 44.78 | 18.63 | 0.645 |
| 13 | 10 | oxalic acid | 2 | 27.89 | 44.56 | 18.27 | 0.655 |
| 14 | 10 | oxalic acid | 1 | 28.90 | 44.67 | 19.17 | 0.663 |
| 15 | 10 | citric acid | 4 | 28.54 | 44.20 | 18.05 | 0.632 |
| 16 | 10 | citric acid | 3 | 27.90 | 42.80 | 18.15 | 0.650 |
| 17 | 10 | citric acid | 2 | 28.13 | 44.20 | 19.34 | 0.688 |
| 18 | 10 | citric acid | 1 | 31.97 | 47.40 | 26.45 | 0.827 |
| 19 | 0 | citric acid | 1 | 31.04 | 47.40 | 26.03 | 0.839 |

The air permeability (Z) was measured in accordance with ISO 2965:2009 and is given in Table 2 for all wrapping papers. The measurement for the papers 2-19 treated with a composition was carried out in a region to which the composition had been applied over the full surface. As can be seen in Table 2, the air permeability decreases from about 60 $cm^3/(cm^2 \cdot min \cdot kPa)$ for the preliminary wrapping paper 1 to about 50 $cm^3/(cm^2 \cdot min \cdot kPa)$ for paper 2, to which a composition with 10% by weight maltodextrin but without acid had been applied. As can be seen for the papers 3-19 in Table 2, the effect of the acid on the air permeability was generally small and with the exception of papers 14 and 18 was always less than 10 $cm^3/(cm^2 \cdot min \cdot kPa)$. The air permeability of the wrapping paper as a whole was then determined by the fraction of the regions of the entire area to which the composition had been applied.

The diffusion capacity (D*), measured in accordance with CORESTA Recommended Method No. 77 (April 2014), behaved similarly to the air permeability (Z). Table 2 shows that there is a decrease from 1.42 cm/s (preliminary wrapping paper 1) to 1.01 cm/s (paper 2) if a composition is applied which contains only maltodextrin. For the papers 3-17 for which the compositions also contained an acid, there was no further reduction in the diffusion capacity to a comparable extent. For the wrapping papers according to the invention 18 and 19, however, the decrease in the diffusion capacity was again significantly greater. According to Table 2, paper 18 reached a diffusion capacity of 0.24 cm/s and paper 19 a diffusion capacity of 0.35 cm/s. Such a substantial decrease in the diffusion capacity can cause that a cigarette with the wrapping paper according to the invention 18 or 19 to self-extinguish if the regions to which the composition is applied are appropriately designed with respect to their geometry. In particular at least one at least 6 mm wide band which runs on the cigarette in the circumferential direction can already be sufficient for self-extinguishing of the cigarette.

In Table 2, in the two columns headed "Filler Content", the filler content ("Value") of the wrapping papers 1-19 and the change ("Change") relative to the preliminary wrapping paper 1 are provided as a percentage. Also in Table 2, in the two columns headed "Transparency", the transparency ("Value") of the wrapping papers 1-19 and the change ("Change") relative to the preliminary wrapping paper 1 in percent are given. The values for the wrapping papers 2-19, to which the corresponding composition has been applied refer to a wrapping paper to which the composition has been applied over the full surface.

The calcium carbonate content in the wrapping papers 1-19 was determined by titration; the transparency was measured in accordance with DIN 53147:1993-01.

The objective of the invention is to produce a higher transparency in some regions of the wrapping paper. The process according to the invention achieves that by applying a composition with an acid to these regions. The acid dissolves a fraction of the acid-soluble filler material. It probably corresponds to the expectation of the skilled person that a reduced filler content leads to higher transparency, but the situation is more complex than the skilled person might believe. It has been found for the papers 2-17 that simply decreasing the filler content by more than 12% (paper 14) is not accompanied by a correspondingly high increase in the transparency. The application of a composition with maltodextrin, but without acid, paper 2, in contrast, leads to an increase in the transparency by 11.36%, but also for the papers 3-17, the transparency is only increased by about 10% to about 15% despite the acid and the somewhat low pH of the composition. As can be seen from the wrapping papers according to the invention 18 and 19, only the use of trivalent acid at a pH below 2 causes a significant increase in the transparency by more than 60%. This result is surprising, as it was not clear that the selection of the acid as well as the pH play such an important role in increasing the transparency. Further, it is surprising that the filler content and the transparency are not so tightly coupled as might be expected by the skilled person, so that both properties can be of importance independently of each other.

TABLE 2

| | | | Filler Content | | Transparency | |
|---|---|---|---|---|---|---|
| Paper No. | Z $cm^3/(cm^2 \cdot min \cdot kPa)$ | D* cm/s | Value $g/m^2$ | Change % | Value % | Change % |
| 1 | 60.68 | 1.42 | 7.5 | | 31.94 | |
| 2 | 50.02 | 1.01 | 7.5 | 0.0 | 35.65 | +11.63 |
| 3 | 50.37 | 0.96 | 7.3 | −3.4 | 36.78 | +15.15 |
| 4 | 44.32 | 0.96 | 8.1 | +8.4 | 35.07 | +9.79 |
| 5 | 48.26 | 0.95 | 8.o | +6.1 | 35.38 | +10.76 |
| 6 | 53.13 | 0.93 | 7.4 | −1.0 | 36.16 | +13.23 |
| 7 | 49.28 | 0.97 | 7.4 | −1.0 | 35.16 | +10.10 |
| 8 | 49.48 | 0.96 | 7.6 | +1.3 | 36.43 | +14.07 |
| 9 | 48.40 | 0.97 | 7.1 | −5.7 | 36.11 | +13.07 |
| 10 | 47.46 | 1.05 | 7.1 | −5.7 | 35.04 | +9.70 |
| 11 | 49.49 | 0.98 | 7.6 | +1.4 | 35.79 | +12.06 |
| 12 | 46.59 | 0.96 | 7.6 | +1.4 | 35.76 | +11.97 |
| 13 | 49.24 | 0.93 | 7.6 | +1.4 | 36.49 | +14.26 |
| 14 | 37.66 | 0.80 | 6.5 | −12.8 | 35.22 | +10.27 |
| 15 | 48.92 | 1.01 | 7.7 | +2.1 | 34.94 | +9.41 |
| 16 | 49.31 | 1.02 | 7.7 | +2.1 | 35.31 | +10.56 |
| 17 | 49.55 | 1.00 | 6.8 | −8.9 | 35.40 | +10.82 |
| 18 | 38.39 | 0.24 | 4.8 | −35.6 | 53.49 | +67.48 |
| 19 | 45.17 | 0.35 | 4.4 | −41.9 | 54.20 | +69.70 |

The invention claimed is:

1. A wrapping paper for smoking articles, which contains pulp fibers and at least one acid-soluble filler material, wherein the content of acid-soluble filler material is at least 10% by weight with respect to the total mass of the wrapping paper, wherein the wrapping paper has regions of lower transparency and regions of higher transparency, wherein the fraction of the mass per unit area of said acid-soluble filler material is at least 10% lower in the regions of higher transparency than in the regions of lower transparency, and wherein for the transparency in the regions of higher transparency, at least one of the following criteria is met:

the transparency measured in accordance with DIN 53147:1993-01 in the regions of higher transparency is at least 20% higher than the transparency measured in accordance with DIN 5314:1993-01 in the regions of lower transparency, or the transparency in the regions of higher transparency is so much higher than in the regions of lower transparency that, when the wrapping paper is wrapped around a tobacco rod with an American Blend tobacco blend, a diameter of 7 mm to 8 mm and a filling density of 0.1 $g/cm^3$ to 0.3 $g/cm^3$, a pattern of lighter and darker sections is obtained which is perceptible to the naked eye, wherein the darker sections correspond to the regions of higher transparency and the lighter sections correspond to the regions of lower transparency.

2. The wrapping paper according to claim 1, in which the regions of higher transparency form regularly arranged geometrical shapes.

3. The wrapping paper according to claims 1, in which the pulp fibers are formed by pulp fibers from long-fiber pulp, short-fiber pulp or mixtures thereof, or in which the pulp fibers are at least partially formed by flax, hemp, sisal, jute, abacá cotton, esparto grass or mixtures thereof.

4. The wrapping paper according to claim 1, which contains at least 50% by weight and at most 90% by weight of pulp fibers, each with respect to the total mass of the wrapping paper.

5. The wrapping paper according to claim 1, in which the acid-soluble filler material is formed by a calcium carbonate, a calcium hydrogen carbonate, a magnesium carbonate or a mixture thereof.

6. The wrapping paper according to claim 1, in which the mean particle size of the acid-soluble filler material is at least 0.1 μm and at most 5 μm.

7. The wrapping paper according to claim 1, in which the wrapping paper contains at least 20% by weight and at most 40% by weight of the acid-soluble filler material, each with respect to the total mass of the wrapping paper.

8. The wrapping paper according to claim 1, in which the content of acid-soluble filler material in a region of higher transparency with respect to the content in a region of lower transparency is reduced by at least 15% with respect to the filler content as the mass per unit area within the respective region.

9. The wrapping paper according to claim 1, in which the content of acid-soluble filler material in a region of higher transparency with respect to the content in a region of lower transparency is reduced by at most 60% with respect to the filler content as the mass per unit area within the respective region.

10. The wrapping paper according to claim 1, in which the fraction of the area of the regions of higher transparency on the entire area of the wrapping paper is at least 3% and at most 97%.

11. The wrapping paper according to claim 10, wherein the fraction of the area of the regions of higher transparency on the entire area of the wrapping paper is between 10% and 70%.

12. The wrapping paper according to claim 1 which, in addition to said at least one acid-soluble filler material, contains at least one non-acid-soluble oxide, hydroxide or silicate or mixtures thereof.

13. The wrapping paper according to claim 12, in which the total content of acid-soluble and non-acid-soluble filler materials is at least 20% by weight of the mass of the wrapping paper, and at most 50% by weight of the mass of the wrapping paper.

14. The wrapping paper according to claim 1, in which the transparency in accordance with DIN 53147:1993-01 of the wrapping paper within regions of higher transparency exceeds the transparency in regions of lower transparency by at least 25% and by at most 300%.

15. The wrapping paper according to claim 14, in which the transparency in accordance with DIN 53147:1993-01 of the wrapping paper within regions of higher transparency exceeds the transparency in regions of lower transparency by at least 50% and by at most 100%.

16. The wrapping paper according to claim 1, in which the transparency in accordance with DIN 53147:1993-01 within the regions of higher transparency is at least 40% and at most 90%.

17. The wrapping paper according to claim 1, in which the transparency in accordance with DIN 53147:1993-01 in the regions of lower transparency is at most 70% and at least 10%.

18. The wrapping paper according to claim 1 with a basis weight of at least 20 $g/m^2$ and at most 45 $g/m^2$.

19. The wrapping paper according to claim 1, in which the tensile strength with respect to the mass, calculated as the quotient of the tensile strength in accordance with ISO 1924-2:2007 and the basis weight in accordance with ISO 536:2012, is at least 0.3 $N \cdot m^2/(15\ mm \cdot g)$ and at most 1.6 $N \cdot m^2/(15\ mm \cdot g)$.

20. The wrapping paper according to claim 1, in which the thickness in accordance with ISO 534:2001 of a single layer is at least 15 μm and at most 100 μm.

21. The wrapping paper according to claim 1, in which the quotient of the thickness in the regions of higher transparency and the thickness in the regions of lower transparency is at least 0.7 and at most 1.6.

22. The wrapping paper according to claim 1, of which the air permeability is at least 20 $cm^3/(cm^2 \cdot min \cdot kPa)$ and at most 200 $cm^3/(cm^2 \cdot min \cdot kPa)$.

23. The wrapping paper according to claim 1, in which the quotient of the air permeability in the regions of higher transparency and the air permeability in the regions of lower transparency is at least 0.4 and at most 1.6.

24. The wrapping paper according to claim 1, of which the diffusion capacity for $CO_2$ is at least 0.05 cm/s and at most 3.5 cm/s.

25. The wrapping paper according to claim 1, in which the $CO_2$ diffusion capacity in the regions of higher transparency is at least 0.01 cm/s and at most 3 cm/s.

* * * * *